US008104408B2

(12) United States Patent
Kanemori et al.

(10) Patent No.: US 8,104,408 B2
(45) Date of Patent: Jan. 31, 2012

(54) DEVICE ATTACHED TO GUIDED VEHICLE TO REMOVE OBSTACLES ON GUIDEWAY

(75) Inventors: Toru Kanemori, Hiroshima-ken (JP); Yoshinori Mitsui, Hiroshima-ken (JP); Kousuke Katahira, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/570,164

(22) Filed: Sep. 30, 2009

(65) Prior Publication Data

US 2010/0258026 A1 Oct. 14, 2010

(30) Foreign Application Priority Data

Apr. 8, 2009 (JP) ..... 2009-093509

(51) Int. Cl.
*B61F 19/00* (2006.01)

(52) U.S. Cl. ..... 104/279; 15/55

(58) Field of Classification Search ..... 104/279; 15/49.1, 54, 55, 78, 82, 87
See application file for complete search history.

(56) References Cited

U.S. PATENT DOCUMENTS

| | | | | | |
|---|---|---|---|---|---|
| 815,308 | A | * | 3/1906 | Perry | 15/55 |
| 1,255,519 | A | * | 2/1918 | Ellis | 15/84 |
| 1,409,011 | A | * | 3/1922 | Kelly et al. | 104/279 |
| 1,469,464 | A | * | 10/1923 | Ursino | 37/104 |
| 2,727,263 | A | * | 12/1955 | Dangremond et al. | 15/55 |
| 2,748,720 | A | * | 6/1956 | Kling | 104/279 |
| 3,004,273 | A | * | 10/1961 | Rushmer | 15/55 |
| 3,005,274 | A | * | 10/1961 | Kershaw | 37/104 |
| 3,137,018 | A | * | 6/1964 | Seffker | 15/55 |
| 3,533,121 | A | * | 10/1970 | Kershaw | 15/55 |
| 4,393,537 | A | * | 7/1983 | Reprogle et al. | 15/348 |
| 4,480,350 | A | * | 11/1984 | White | 15/207.2 |
| 4,741,072 | A | * | 5/1988 | Wilkerson | 15/312.1 |
| 4,811,447 | A | * | 3/1989 | Everson | 15/207.2 |
| 5,249,332 | A | * | 10/1993 | Wilkerson | 15/384 |
| 5,437,233 | A | * | 8/1995 | Richter | 104/279 |
| 5,493,795 | A | * | 2/1996 | Bail | 37/104 |
| 5,579,553 | A | * | 12/1996 | Holley | 15/55 |
| 5,673,626 | A | * | 10/1997 | Jaeggi | 104/279 |
| 5,695,574 | A | * | 12/1997 | Falardeau et al. | 134/6 |
| 6,154,920 | A | * | 12/2000 | Petrole et al. | 15/349 |
| 2007/0039514 | A1 | * | 2/2007 | Godard et al. | 104/279 |
| 2010/0258026 | A1 | * | 10/2010 | Kanemori et al. | 104/279 |

FOREIGN PATENT DOCUMENTS

| | | | |
|---|---|---|---|
| JP | 10203360 | A * | 8/1998 |
| JP | 2000120037 | A | 4/2000 |

* cited by examiner

*Primary Examiner* — Joe Morano, IV
*Assistant Examiner* — Jason C Smith
(74) *Attorney, Agent, or Firm* — Kanesaka Berner & Partners

(57) ABSTRACT

An obstacle-removing device having brushes that can be retracted when the device is at the rear side in the traveling direction of the vehicle. The device includes a vertical frame positioned to the leading end in the traveling direction of the vehicle, and a lifting/lowering device attached to the vertical frame to lift and lower a brush holder having brushes and attached to a vertically movable member which can be lifted and lowered by the lifting/lowering device. The brush holder is pivotally attached to the vertically movable member such that the brush holder is tilting forward when the brushes held by the brush holder contact the running surface to perform an obstacle-removing operation.

10 Claims, 10 Drawing Sheets

DEVICE ATTACHED TO GUIDED VEHICLE TO REMOVE OBSTACLES ON GUIDEWAY

BACKGROUND OF THE INVENTION

1. Field of the Invention

The present invention relates to an obstacle-removing device for a guided vehicle to remove obstacles on exclusive guideway, particularly to a device to remove fallen snow, a massive amount of fallen leaves or fallen sand, and in some cases, dead animals such as crabs, frogs, etc., accumulated or lying on the guideway, with increased efficiency and without breakage of the device.

2. Description of the Related Art

Recent years, a medium capacity transit system, one of so-called new transit systems, in which guided vehicles equipped with rubber tires travel along exclusive guideway, has become widespread. In some cases the vehicle is equipped with guide wheels for guiding the vehicle along the guideway sometimes it happens that obstacles such as fallen snow, a massive amount of fallen leaves or fallen sand, and dead animals such as crabs, frogs, etc. lying on the exclusive guideway obstruct the passage of the guided vehicle, and the obstacles must be removed by the running vehicle itself.

For example, a snowplow attachment for a vehicle is disclosed in patent literature 1(Japanese Laid-Open Patent Application No. 2000-120037). The snowplow attachment will be attached to both the front and rear ends of a multiple-car vehicle. A supporting frame is provided to the vehicle in the front of front wheels and in the rear of rear wheels. A left and right snowplow are attached to each of the supporting frames respectively such that the snow-pushing brush of each of the left and right plows is skewed to face the left and right running surfaces of the exclusive guideway at an angle. A lifting/lowering device for lifting the plow to a retracted position and to lower the same to a snow removing position is mounted to the supporting frame. The plow is lowered so that the bottom edge of the snow-pushing brush contacts the running surface of the guideway when the plow is lowered to the snow removing position.

With the snowplow disclosed in the patent literature 1, the snow accumulating ahead of the vehicle is removed toward both sides of the guideway without leaving snow on the running surface by allowing the snow-pushing brush of the plow to contact the running surface of the guideway, thereby preventing occurrence of wheel slip.

The snowplow attached to the front of the vehicle in running direction thereof is lowered to the snow removing position, and the snowplow positioned to the rear of the vehicle in running state is lifted to a retracted position. Pushing out the snow accumulated on the running surface to both sides of the running surface is difficult to perform only with the brush as the snow does not slide smoothly toward both sides disturbed by the rough surface of the brushes, so a snow push-out plate is provided in front of each snow-pushing brush in order to push out the snow smoothly to both sides of the running surface. As material of the snow-pushing brush is desired such a material having sufficient rigidity and property of being not easily adhere to with snow, and a bamboo brush has long been used as most suitable one. Recent years, a brush made of synthetic resin is used.

A dual mode maintenance truck for performing various maintenance operations such as renewal of overhead catenary, repairing of pantographs, renewal of electric poles, etc. in railroad track has been proposed for the purpose of impelling laborsaving, promotion of efficiency, and enhancement of safety by improving working procedure. As two kinds of track gauges, i.e. standard-gauge (1.435 mm width) and narrow-gauge (1.067 mm width) are used in Japan, a running mechanism for a dual mode maintenance truck which can be changed over quickly and safely from using on the narrow-gauge railway to using on the standard-gauge railway and vice versa is provided in Japan.

However, with the running mechanism for a dual mode vehicle, when running on a narrow-gauge railway in winter season and removal of snow on the rails was already performed by an obstacle-removing device of another train, the snow removed from the surfaces of the rails and accumulated outside the rails forming mound of snow and ice interferes with the outside rear tired wheels for running on standard-gauge railways, and the dual mode truck can not be allowed to run for concern of occurrence of derailment. Further, when freezing occurred on surfaces of the rails due to very low temperature, slipping of the wheels contacting the surfaces of the rails, particularly rear tired wheels which are driving wheels occurs and smooth and safe running of the truck is obstructed. Therefore, the variety of maintenance operations in railways cannot be performed efficiently under such a condition as mentioned above.

To cope with this, a running mechanism for a dual mode vehicle is disclosed in patent literature 2 (Japanese Laid-Open Patent Application No. 10-203360). The running mechanism is composed such that: a snow removing device consisting of a horizontal auger having a spiral blade for removing snow and a motor for rotating the auger, an ice removing device consisting of a rotary brush and a motor for rotating the brush, are attached at the left and right of the front of the vehicle so that they can be lifted together; and an ice removing device is provided to remove the ice on the railways by blasting warm exhaust gas from the engine of the vehicle on to the surfaces of the railways.

However, with the snow removing device disclosed in the patent literature 1, the brush is pushed on to the concrete running surface so that the bristles of the brush are bent when removing snow, so the bristles tend to become loose and wear in a short time of use. Further, the guideway joint gaps become large in wintertime due to contraction of the guideway viaduct, and the bristles of the brush drops into the joint gap to be broken there. Further, it may occur that fallen snow adheres to the brush lifting/lowering mechanism and the spring for lifting the brush freezes there, resulting in the brush cannot be retracted.

On the other hand, when the fallen snow is removed to both sides of the vehicle by each of the left and right snowplows skewed to face the left and right running surface of the exclusive guideway at an angle, the snow swept toward both sides of the guideway accumulates in both sides of the guideway. When the amount of the accumulated snow increases, apart of the accumulated snow returns onto the running surface of the guideway on which the tired wheels tread on, because the both side spaces are restricted by the sidewalls of the guideway and not so large.

The snow returned onto the running surface of the guideway on which the wheels tread is formed into a compressed snow layer. Therefore, the running surface rises up and friction between the wheel and running surface decreases, and stable traveling of the vehicle becomes impossible.

When relatively a hard snow layer is formed on the running surface, it cannot be removed by the brush of the snowplow.

Further, there may occur a problem that the snow thrown up by the brush adheres to the brush lifting mechanism causing failure of the mechanism or that the thrown up snow falls on the running surface on which the tired wheels tread and forms a compressed snow layer.

The dual mode maintenance truck disclosed in the patent literature 2 is equipped with a left and right snow removing devices, each comprises a snow removing device consisting of a horizontal auger to remove snow and a motor for rotating the auger, an ice removing device consisting of a rotary brush and a motor for rotating the brush, and an ice removing device to remove the ice on the railways by blasting warm exhaust gas from the engine of the truck on to the surfaces of the railways, so the device becomes fairly a large scaled one and fairly large manufacturing cost is required.

SUMMARY OF THE INVENTION

Therefore, an objective of the invention is to provide an obstacle-removing device for guided vehicles to remove obstacles on guideway, which is simple in configuration, low in manufacturing cost, and can remove the obstacles steadily and effectively, and of which the brushes can be retracted easily when the device is in the rear side of traveling direction of the vehicle.

Further, the invention aims to provide an obstacle-removing device, with which the bristles of the brush do not become loose easily, that the snow removed to the side of the guideway does not return toward the running surface where the wheels of the vehicle tread on when space for allowing accumulation of the removed snow becomes deficient there, that the bristles of the brush do not intrude into joint gap of the running surface to be damaged there when the gap becomes large in winter season due to contraction of the viaduct material, and that the brush can not be moved up due to malfunction of the lifting/lowering mechanism caused by adhesion of snow and freezing of it.

To attain the objective, the present invention proposes an obstacle-removing device of a guided vehicle for removing obstacles on guideway comprising; a vertical frame attached to the front end(leading end in traveling direction) of the vehicle, and a lifting/lowering mechanism attached to said vertical frame to lift and lower a brush holder attached to a vertically movable member which can be lifted and lowered by the lifting/lowering mechanism, the brush holder having a brush for removing obstacles on the guideway; wherein the brush holder is pivotally attached to the vertically movable member such that the brush holder is tilted forward when the brush held by the brush holder contacts the running surface to perform obstacle-removing operation.

As the brush holder is pivotally attached to the vertical frame so that it tilts forward when performing obstacle-removing operation, the brush can be maintained to contact the running surface even when vertical force it receives from the running surface fluctuates to some extent due to irregularity of the surface in obstacle-removing operation and the running surface can be effectively swept, and in a state the device is in the rear of the vehicle, the brush holder can be rotated about the pivot point so that the bottom of the brush is retracted even when the lifting/lowering mechanism malfunctions.

By composing such that the brush holder is connected to the vertically movable member via two pivot points by providing an intermediate connection member, when the vehicle travels in a state the device is positioned to the rear end thereof, even in case any one of the lifting/lowering mechanism or the first pivoting or second pivoting point is frozen and the brush holder cannot be lifted or rotated about the frozen pivot point, the brush holder can be lifted or rotated so that the brush is retracted.

By composing such the vertical frame is attached horizontally rotatable and a means for fixing the vertical frame at determined rotational position is provided, the skew angle of the brush holder can be changed from a state for removing the obstacles toward outside of the vehicle to a state for removing the obstacles toward vehicle underfloor between the left and right wheels of the vehicle. Therefore, when the amount of obstacles removed increases and the obstacles accumulated near the side wall of the guideway return toward the running surface where the wheels of the vehicle tread on, obstacles can be removed toward inner side of the vehicle between the left and right wheels by rotating the vertical frame to change the skew angle of the brush holder. Particularly, when removing snow on the road, it is prevented from occurring that the snow removed toward outside of the vehicle returns toward the running surface where the wheels tread on becomes compressed snow layers.

By composing such that the lifting/lowering mechanism is provided with a ratchet rail, and a ratchet claw is pivotally attached to the vertically movable member, to which the brush holder is connected, so that upward movement of the brush holder is prevented when the brush holder is lowered by the engagement of the ratchet claw with the ratchet rail, the brush is locked at a lowered position and it is not needed to maintain pushing the brush holder during obstacle-removing operation.

The ratchet claw is shaped in a letter 'L' shape with its central part pivotally supported by the vertically movable member, an end pivotally connected to the lifting/lowering mechanism, and the other end formed into a claw to be engaged with the ratchet rail, so when intending to lift the brush holder, the engagement of the ratchet claw with the ratchet rail is released and the brush holder can be lifted.

Further, by bundling the bristles of the brush by winding with a string or covering with a tube in a range from the bottom of the brush holder to the top of the brush, the bundles of the brush do not become loose easily and rapid abrasion of the bristles due to contact with the running surface can be prevented. Furthermore, by arranging two brushes side by side in two parallel rows, obstacle can be removed steadily without excessive bending of the bristles and in addition occurrence of intrusion of the bristles into joint gap of the running surface to be damaged there is prevented.

Further, by attaching a brush cover to the brush holder with its top face protruding forward from the top end of the brush holder in a curved form, occurrence of such phenomena is prevented that snow thrown up by the brush flies up over a brush holder to adhere to the device and freeze them causing malfunction of them, and that the thrown up snow falls on the running surface on which the wheels tread are formed into compressed snow layers.

Further, by composing the lifting/lowering mechanism such that a return spring covered by a spring cover is provided to push the vertically movable member upward and the vertically movable member is pushed down against the upward force of the return spring, lifting force required for the lifting/lowering mechanism to lift the brush holder is decreased.

By providing a brush stopper to the vertical frame between the vertical frame and brush, the brush can be supported by the brush stopper not to be rotated to be retracted when performing obstacle-removing operation removing fallen snow, a massive amount of fallen leaves or fallen sand, and in some cases, dead animals such as crabs, frogs, etc., accumulated or lying on the guideway.

As the brush holder is pivotally attached to the vertical frame so that it tilts forward when performing obstacle-removing operation, the brush can be maintained to contact the running surface even when vertical force it receives from the running surface fluctuates to some extent due to irregularity of the surface in obstacle-removing operation and the running surface can be effectively swept, and in a state the device is in the rear of the vehicle, the brush holder can be rotated about the pivot point so that the brush is retracted even when the lifting/lowering mechanism malfunctions.

By providing the second pivoting point, even when the vehicle travels in a state the device is positioned to the rear end thereof, and even in case any one of the lifting/lowering mechanism or the first pivoting or second pivoting point is frozen and the brush holder cannot be lifted or rotated about the frozen pivot point, the brush holder can be lifted or rotated so that the brush is retracted. Further, by providing the vertical frame available to be fixed at a positions of removing the obstacles toward outside of the vehicle and toward vehicle underfloor between the left and right wheels of the vehicle, even when the amount of obstacles removed increases and the obstacles accumulated near the side wall of the guideway return toward the running surface where the wheels of the vehicle tread on, obstacles can be removed toward vehicle underfloor between the left and right wheels preventing from occurring that the snow removed toward outside returns to the running surface where the wheels tread on and freezes the running surface.

By providing the ratchet rail to the vertical frame and providing the ratchet claw to the brash holder side, upward movement of the brush holder is prevented by the engagement of the ratchet claw with the ratchet rail, the brush is locked at a lowered position and it is not needed to maintain pushing the brush holder during obstacle-removing operation.

BRIEF DESCRIPTION OF THE DRAWINGS

FIG. 2A is a side view showing the link mechanism attached to the supporting frame, FIG. 2B is a side view showing the lifting/lowering mechanism, and FIG. 2C is a partial sectional side view showing the return spring part.

FIG. 7D is a side view showing the link mechanism attached to the supporting frame, FIG. 7E is a side view showing the lifting/lowering mechanism, and FIG. 7F is a partial sectional side view showing the return spring part.

FIG. 9G is a side view showing the link mechanism attached to the supporting frame, FIG. 9I is a partial sectional side view showing the return spring part.

DETAILED DESCRIPTION OF THE PREFERRED EMBODIMENTS

Figure 1:
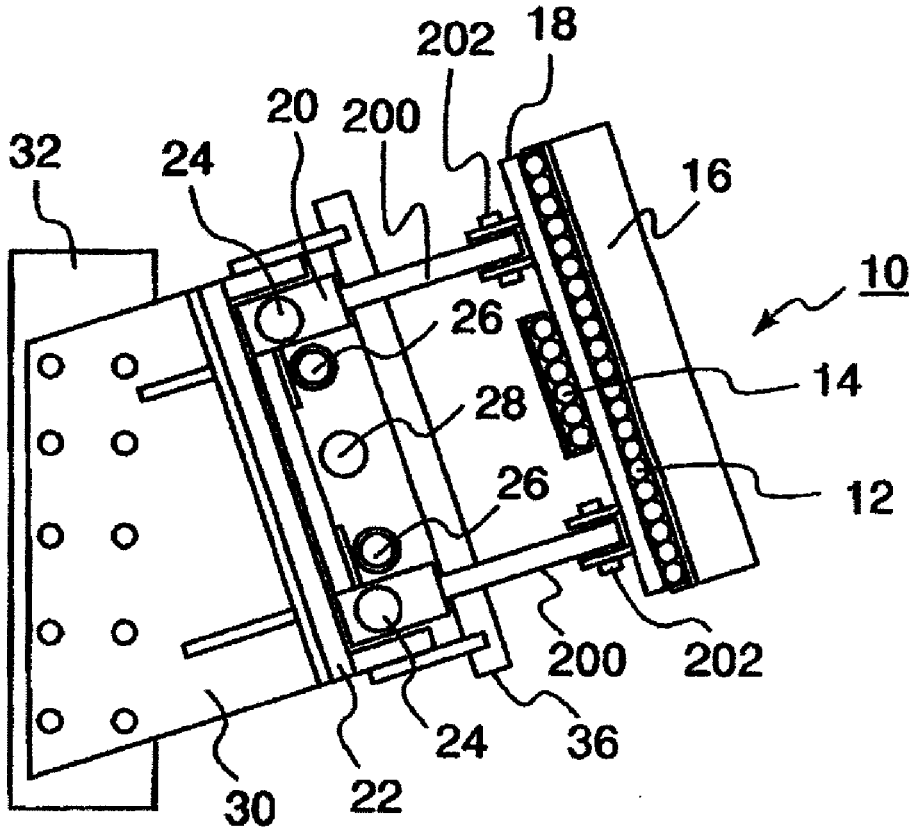
FIG. 1 is a plain view of the obstacle-removing device for guided vehicles of the first embodiment according to the invention.

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

First, the contour of the present invention will be explained. The invention relates, as mentioned before, to an obstacle-removing device attached to a guided vehicle for traveling on exclusive guideway. The device is attached to the left and right side of both front and rear ends of the guided vehicle such that each device is skewed to face the left and right wall of the exclusive guideway at an angle respectively under normal conditions. The device comprises; a vertical frame of a certain width positioned to the leading end of the vehicle in direction of travel of the vehicle, and a lifting/lowering mechanism for lifting and lowering a brush holder holding a brush for removing obstacles on the running surface similarly as does the snow removing device of the patent literature 1; and the brush holder is connected to a vertically movable member in the lifting/lowering mechanism pivotally to be able to be rotated in a vertical plane perpendicular to the vertical frame. When performing of removing the obstacles, the brush holder is slanted forward so that the brush can be maintained to contact the running surface even when vertical force it receives from the running surface fluctuates to some extent due to irregularity of the surface in obstacle-removing operation, so the running surface can be effectively swept, and when the vehicle travels in a state the device is positioned to the rear end thereof, the brush holder can be rotated easily about the pivot point so that the brush is retracted even in case the lifting/lowering mechanism does not work and the brush can not be lifted.

It is preferable to provide an intermediate connection member between the brush holder and the vertically movable member so that the brush holder is pivotally connected to the intermediate connection member and the intermediate connection member is pivotally connected to the vertically movable member, thus the brush holder is double pivotally connected via a first pivot point and second pivot point to the vertically movable member.

With this configuration, when the vehicle travels in a state the device is positioned to the rear end thereof, even in case any one of the lifting/lowering mechanism or the first pivoting or second pivoting point is frozen and the brush holder can not be lifted or rotated about the frozen pivot point, the brush holder can be lifted or rotated so that the brush is retracted.

Further, according to the invention, by composing such that the vertical frame to which the lifting/lowering mechanism is mounted is rotatable horizontally so that the skew angle of the brush holder can be changed from a state for removing the obstacles toward outside of the vehicle to a state for removing the obstacles toward vehicle underfloor between the left and right wheels of the vehicle. Therefore, when the amount of obstacles removed increases and the obstacles accumulated near the side wall of the guideway return toward the running surface where the wheels of the vehicle tread on, obstacles can be removed toward vehicle underfloor between the left and right wheels by rotating the vertical frame to change the skew angle of the brush holder. Particularly, when removing snow on the running surface, it is prevented from occurring that the snow removed toward outside of the vehicle returns toward the running surface where the wheels tread on to become compressed snow layers.

It is also preferable to compose such that the lifting/lowering mechanism is provided with a ratchet rail, and a ratchet claw is pivotally attached to the vertically movable member, to which the brush holder is connected, so that upward movement of the brush holder is prevented by the engagement of the ratchet claw with the ratchet rail when the brush holder is lowered. With the construction, the brush is locked at a lowered position and it is not needed to maintain pushing the brush holder during obstacle-removing operation.

The ratchet claw is shaped in a letter 'L' shape with its central part pivotally supported, an end thereof pivotally connected to the lifting/lowering mechanism, and the other end formed into a claw to be engaged with the ratchet rail, so when intending to lift the brush holder, the engagement of the ratchet claw with the ratchet rail is released and the brush holder can be lifted.

The brushes for removing obstacles on the guideway is bundled by winding with a string or covering with a tube in a range from the bottom of the brush holder to the top of the brush, so the bundles of the brushes do not become loose easily and rapid abrasion of the bristles due to contact with the running surface can be prevented. Further, by arranging two brushes side by side in two parallel rows, obstacle-removing ability is increased and in addition it is prevented that the bristles of the brush intrude into joint gap of the running surface to be damaged there.

Further, by attaching a brush cover to the brush holder with its top face protruding forward from the top end of the brush holder in a curved form, occurrence of such phenomena is prevented that snow thrown up by the brush flies up over a brush holder to adhere to the operative mechanisms of the device and freeze them causing malfunction of them, and that the thrown up snow falls on the parts of running surface on which the wheels tread are formed into compressed snow layers.

Hereinabove has described the outline of the invention. Next, a first embodiment of the invention will be explained with reference to FIGS. 1-3. First, a guided vehicle equipped with the obstacle-removing device of the first embodiment for removing obstacles on guideway will be explained referring to FIG. 3 showing a plain view thereof.

Figure 3:
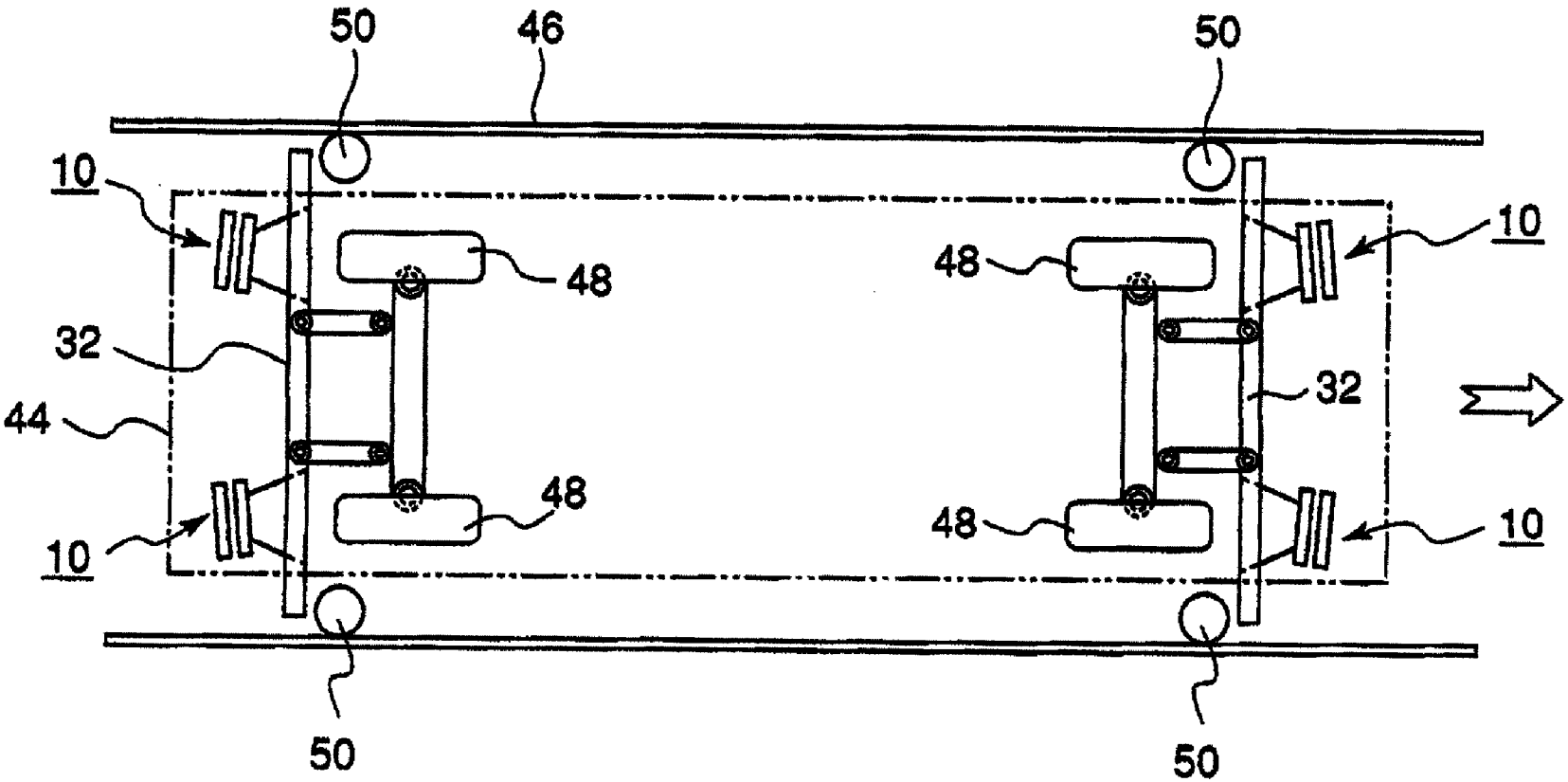
FIG. 3 is a plain view of the guided vehicle equipped with the obstacle-removing device of the first embodiment for removing obstacles on guideway.

In FIG. 3, reference numeral 10 is an obstacle-removing device for removing obstacles on guideway, 32 is a guide beam attached to the vehicle at the front and rear respectively thereof. The obstacle-removing devices 10 and guide wheels 50 are attached to the guide beam 32. Reference numeral 44 indicated by a chain double-dashed line shows the contour of the vehicle, 46 is a guide rail for guiding the guided vehicle 44 by allowing the left and right guide wheels 50 to contact with the guide rail, 48 are wheels of the guided vehicle 44. The guided vehicle 44 travels on exclusive guideway on the wheels 48 propelled by propulsion and driving mechanisms not shown in the drawing and guided by the guide rail 46 via the guide wheels 50.

Two obstacle-removing devices 10 are attached to the left and right part of each of the front and rear guide beams 32 respectively such that, under normal conditions, each of the devices is skewed to face the running surface at an angle respectively. The obstacle-removing devices positioned to the front of the vehicle in running direction thereof are lowered to allow the brush contacting the running surface to remove obstacles on the running surface such as so that fallen snow, a massive amount of fallen leaves or fallen sand, and in some cases dead animals such as crabs, frogs, etc., accumulated or lying on the guideway, can be removed by the devices as the vehicle travels. The obstacle-removing devices positioned to the rear of the vehicle in running state are lifted so that they do not contact the running surface to evade wear of the brush due to friction with the running surface.

Figure 2C:
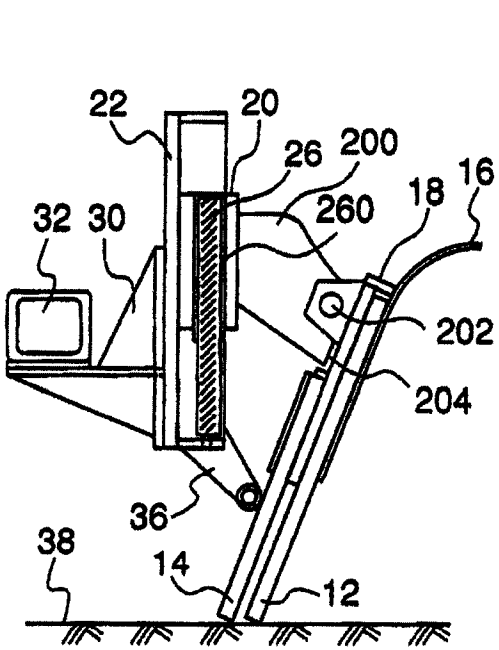
FIGS. 2A, 2B, and 2C are a side view of the first embodiment of the obstacle-removing device for guided vehicles.
Figure 2B:
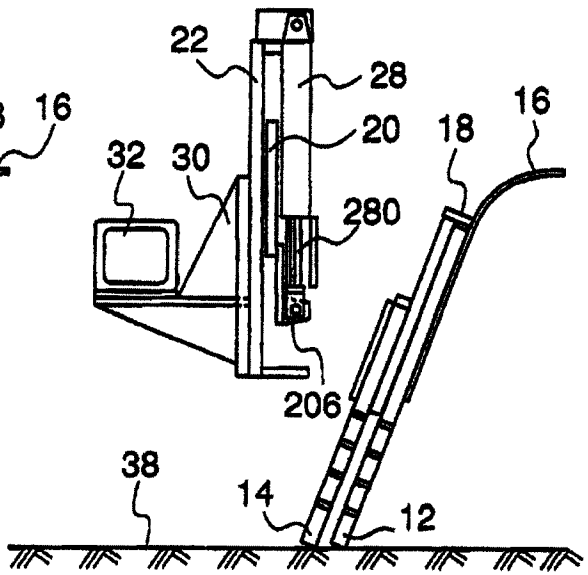
Figure 2A:
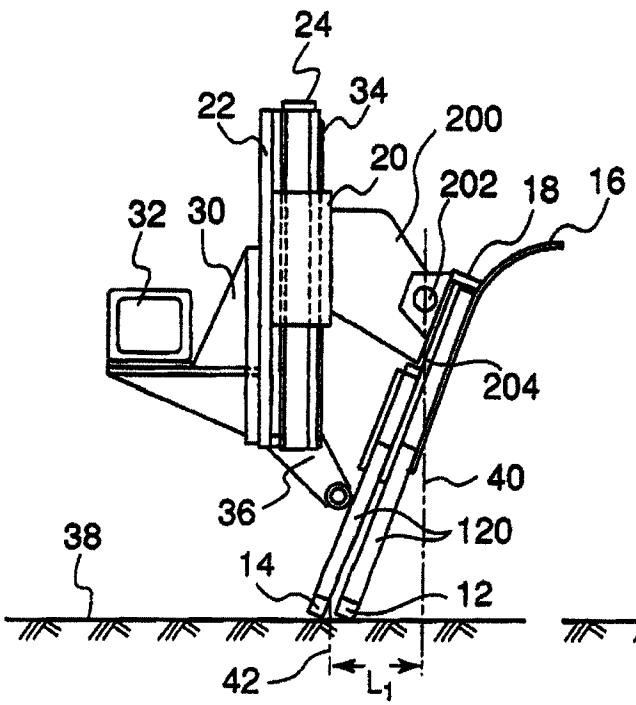

FIG. 1 is a plain view of the obstacle-removing device for guided vehicles of the first embodiment, FIG. 2A is a side view showing the link mechanism attached to the supporting frame 20, FIG. 2B is a side view showing the cylinder 28 of the lifting/lowering mechanism, and FIG. 2C is a partial sectional side view showing the return spring 26. In these drawings, the same components are denoted by the same reference numerals.

Referring to FIGS. 1 and 2A-C, reference numeral 12 and 14 is a brush 'a' and brush 'b' for removing obstacles on guideway, 16 is a brush cover having a forwardly curving at its upper portion for preventing occurrence of such a phenomena for example that snow thrown up by the brush flies up over a brush holder 18 to adhere to the obstacle-removing devices 10 and freezes them causing malfunction of the devices, and that the thrown up snow falls on the parts of running surface on which the wheels tread to form them into compressed snow layers causing troubles in traveling of the vehicle. Reference numeral 20 is a supporting frame having a supporting plate 200 to which the brush holder 18 holding a brush 'a' 12 and brush 'b' 14 is pivotally connected via connecting pins 202. The supporting frame 20 can be moved up and down by means of a cylinder 28 along guide shafts 24. Reference numeral 22 is a vertical frame of a bracket 30 attached to the guide beam 32, 26 is a return spring to exert return force on the supporting frame 20 when it is lowered by the cylinder 28, 36 is a brush stopper for preventing the brush from bending when it is pushed by obstacles on the guideway as the vehicle travels.

The brush used in the device of the invention comprises a brush 'a' 12 and a brush 'b' 14. The brush 'a' 12 is composed of a plurality of bundle of bristles made of bamboo or synthetic resin having rigidity arranged along width direction of the vehicle travel and held by the brush holder 18. The brush 'b' 14 is also composed of a plurality of bundle of bristles arranged parallel to the brush 'a' 12 in shorter length than the brush 'a' 12 provided on the immediate rear thereof and is held also by the brush holder 18. The brush 'b' 14 is provided for the purpose of preventing occurrence that the brush 'a' 12 drops into a gap widened due to contraction of the concrete running surface in winter time to be damaged there and also for the purpose of backing up the brush 'a' to increase the rigidity of the brushes.

The brush holder 18 is connected pivotally to the supporting plates 200 of the supporting frame 20 via the connecting pins 202. Rotation of the brush holder 18 is restricted by a stopper face 204 of the supporting plate 200. The bracket 30 is attached to the guide beam 32 to face at a slant toward the side end of the guideway, and two guide shafts 24 are provided to the bracket 30 which is integrally formed with the supporting frame 22 such that the guide shafts 24 extend vertically parallel to the vertical frame 22. The supporting frame 20 has two through holes, and it is attached slidably to the bracket 30 by allowing the through holes to be engaged with the guide shafts 24. The supporting frame 20 is energized upward by the return springs 26.

Referring to FIGS. 2A-C showing side views of the device, reference numeral 34 is a bellows for covering the guide shaft 24, along which the supporting frame 20 slides up and down, so that snow does not adhere to the sliding surface, 38 is a running surface, 40 is a vertical line indicating the center position of the connection pin 202, and 42 is a vertical line indicating the center of contact of the brushes 12, 14 to the running surface 38. Reference numeral 204 is the stopper face of the supporting plate 200 for restricting rotation of the brush holder 18 supported pivotally by the supporting plate 200 of the supporting frame 20, 206 is a connection part of a piston rod 280 of the cylinder 28 to the supporting frame 20, and 260 is a spring cover for protecting the return spring 26 so that snow, etc. does not adhere to the spring.

As shown in FIG. 2A, the brush holder 18 can rotate about the connection pin 202 counterclockwise, and clockwise rotation is restricted by the stopper face 204 of the supporting plate 200. Even when the brush 'a' 12 and brush 'b' 14 are pushed strongly by a heavy obstacle on the running surface as the vehicle advances, the brushes are supported by a brush stopper 36 and the obstacle can be removed. The stopper face 204 of the supporting plate 200 and the brush stopper 36 are provided such that, when the brush holder 18 contacts the stopper face 204 of the supporting plate 200 and also restrained by the brush stopper 36, the contact center 42 of the brushes to the running surface 38 is positioned backward by L1 from the center line 40 indicating the projection of the pivot center of the brush holder 18 on to the running surface 38.

Therefore, though the ends of the brush 'a' and 'b' are near the vertical center line 40 when the supporting frame 20 is lowered until the bottoms of the brushes contact the running surface before the vehicle moves, once the vehicle moves forward or when the supporting frame 20 is lowered while the vehicle is in motion, the brush holder 18 is rotated clockwise by the force exerting on the bottoms of brushes due to friction with the running surface 38 until the distance of the contact center 42 of the brushes to the running surface 38 from the vertical center line 40 becomes L1, that is, the brush holder is slanted forward. The brushes are stopped of their clockwise rotation by the stopper face 204 and brush stopper 36 in this slanted attitude of the brush holder 18, and the brushes can be maintained to contact the running surface even when vertical force they receive from the running surface fluctuates to some extent due to irregularity of the surface in obstacle-removing operation, so the running surface can be effectively swept.

In FIG. 2A, reference numeral 120 indicates strings bundling up the bristles or tubes covering the bundle of bristles. The bristles of the brushes 12, 14 are bound with the strings or covered by the tubes along the zone protruding from the brush holder 18 so that the brushes are prevented from becoming loose and damaged due to hard force to push aside obstacles on the running surface. When using a tube to cover a bundle of bristles, it is preferable to use a tube having heat shrink feature such as a vinyl tube.

To the brush holder 18 holding the brushes 'a' and 'b' the brush cover 16 is attached, which has a forwardly curving upper portion for preventing occurrence of such a phenomena for example that snow thrown up by the brushes flies up over a brush holder 18 to adhere to the obstacle-removing device 10 and freeze them causing malfunction of them, and that the thrown up snow falls on the parts of the running surface on which the wheels tread to form them into compressed snow layers causing troubles in traveling of the vehicle.

FIG. 2B is a side view showing the relation of the pneumatic cylinder 28 for lifting and lowering the supporting frame 20. The supporting frame 20 is connected to the piston rod 280 of the pneumatic cylinder 28 at the connection part 206 thereof. The supporting frame 20 is lifted or lowered by supplying air to the pneumatic cylinder 28.

FIG. 2C is a side view showing the configuration around the return spring 26. The return spring 26 is provided near each of the guide shafts 24 of the vertical frame 22, and covered by the spring cover 260 so that snow does not adhere and freeze on the spring 26, which prevents the malfunction of the spring. The return spring 26 is provided so that the supporting frame 20 can be lifted by the return spring 26 even when the pneumatic cylinder 28 does not work and the supporting frame 20 cannot be lifted by the pneumatic cylinder. Therefore, the return spring 26 must be protected against occurrence of failure of its function.

With the configuration of the obstacle-removing device for guided vehicle, the supporting frame 20 is lowered by means of the pneumatic cylinder 28 against the upward exerting force of the return spring 26. The force applies to the brushes 12, 14 contacting the running surface as the vehicle travels can result in a force perpendicular to the brushes which is supported by the brush stopper 36 or the stopper face 204, so upward force from the running surface via the brushes does not applies to the pneumatic cylinder and therefore an pneumatic cylinder of small load capacity can be utilized.

Further, in a state the obstacle-removing device is positioned to the rear of the vehicle traveling direction, the brush holder 18 can be rotated counterclockwise viewed from the left of travel direction about the connection pin 202, so even if the pneumatic cylinder 28 of the lifting/lowering mechanism does not actuate due to freezing or other accidents, and the brushes can escape from being strongly pushed to the running surface as the vehicle travels.

Figure 4:
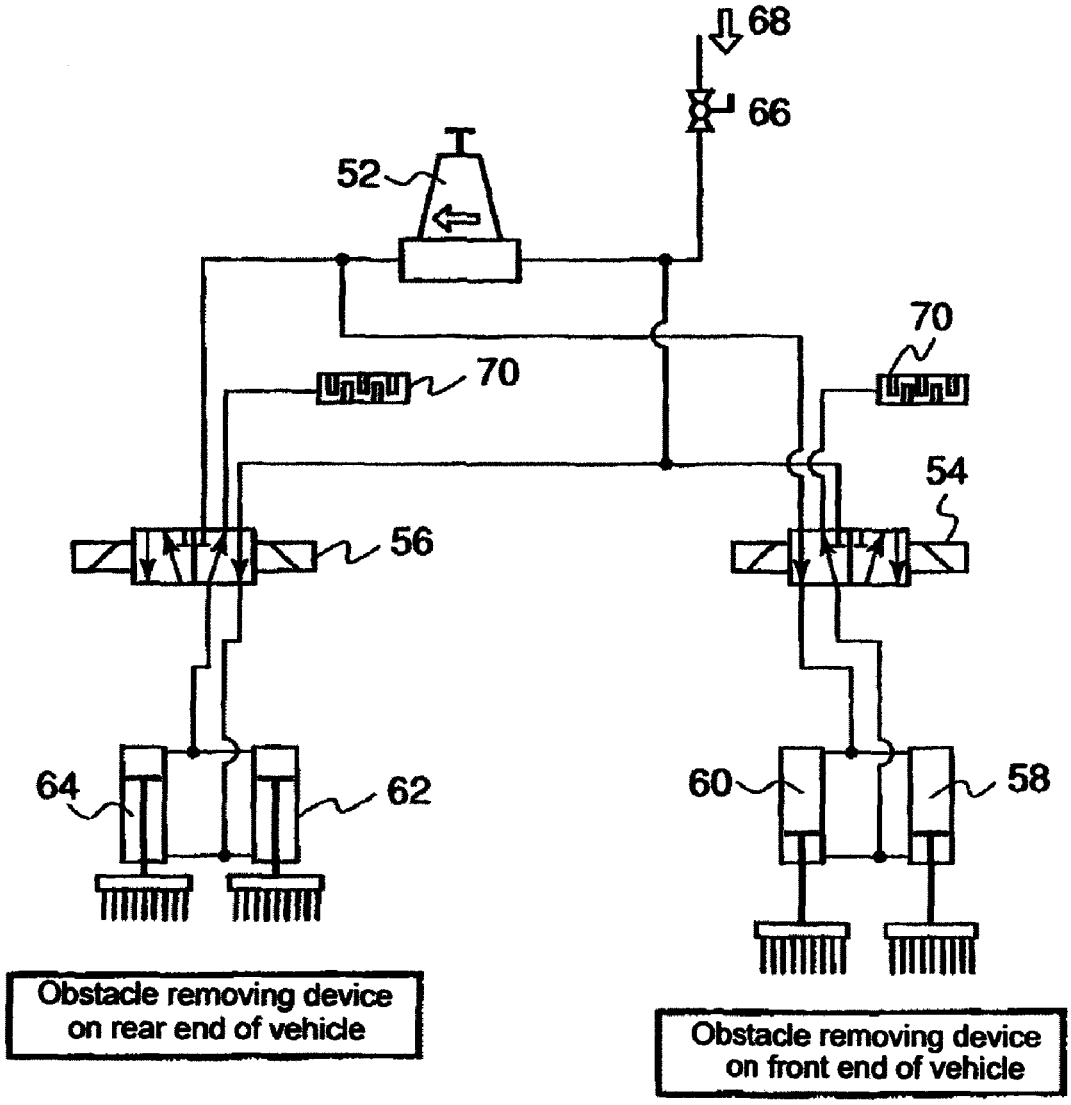
FIG. 4 is a circuit diagram of an example of pneumatic circuit of the obstacle-removing device according to the invention.

FIG. 4 is a circuit diagram of an example of pneumatic circuit of the obstacle-removing device of the invention. In the drawing, reference numeral 52 is a pressure reducing valve. Reference numeral 54 and 56 is respectively an electromagnetic valves for controlling supply of air to the pneumatic cylinders of the lifting/lowering mechanisms of the obstacle-removing devices mounted at front and rear ends of vehicle. Reference numeral 58 and 60 is respectively an pneumatic cylinder R1 and L1 for lifting and lowering the obstacle-removing device mounted at the front right and left of the vehicle, 62 and 64 is respectively an pneumatic cylinder R2 and L2 for lifting and lowering the obstacle-removing device mounted at the rear right and left of the vehicle, 66 is a cutout cock, 68 is a compressed air from a compressed air source, and 70 is a silencer.

Figure 5:
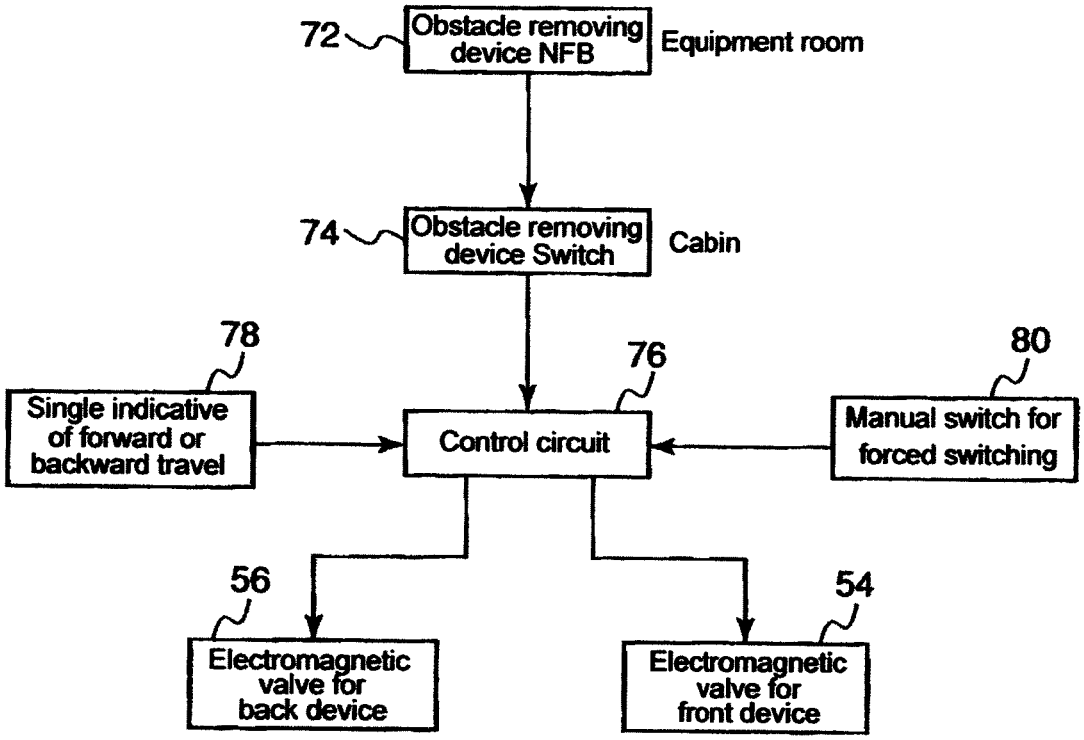
FIG. 5 is a block diagram of an example of pneumatic circuit of the obstacle-removing device according to the invention.

FIG. 5 is a block diagram of an example of pneumatic circuit of the obstacle-removing device of the invention. In the drawing, reference numeral 72 is a NFB (non-fuse breaker) of the obstacle-removing device provided in vehicle, 74 is a switch of the obstacle-removing device provided in the cabin of the vehicle, 76 is a control circuit, 78 is a vehicle state signal of forward/backward setting, 80 is a manual switch for forced switching, and 54 and 56 is respectively electromagnetic valves for the front and rear obstacle-removing devices.

Set pressure of the pressure reducing valve 52 in FIG. 4 is determined to a minimum pressure that the brushes 'a' and 'b' do not loose contact with the running surface when removing obstacles on the running surface, taking into consideration of the lifting force of the return spring 26, own mass of the obstacle-removing device, slide resistance exerted from the guide shafts 24, etc.

Referring to FIG. 5, when the obstacle-removing device switch 74 is turned on, the control circuit 76 detects traveling direction by receiving the signal 78 showing travel direction of the vehicle and also confirms whether signal directing enforced lifting or enforced lowering of the brushes is received from the manual switch 80, and sends a signal to the electromagnetic valve 54 to allow the front device to lower the brushes and a signal to the electromagnetic valve 56 to allow the rear device to lift the brushes. The electromagnetic valve 54 is switched upon receiving the signal to supply air to the front pneumatic cylinders 58 and 60 from the upper end thereof to lower the brushes of front devices, and electromagnetic valve 56 is switched upon receiving the signal to supply air to the rear pneumatic cylinders 62 and 64 from the lower end thereof to lift the brushes of rear devices. Air is supplied from the air source 68 via the pressure reducing valve 52, the left and right front obstacle-removing devices are lowered so that obstacles on the running surface are removed by the brushes of the front devices, and the left and right rear obstacle-removing devises are lifted so that they do not contact the running surface.

In the first embodiment of the obstacle-removing device of the guided vehicle as explained above, the brush holder 18 is connected to the supporting plate 200 of the supporting frame 20 via a single set of connection pins 202. In case the connection pins 202 are frozen and the rear obstacle-removing devices can no be rotated so that the brushes are retracted, the brushes of the rear devices may be broken.

Figure 6:
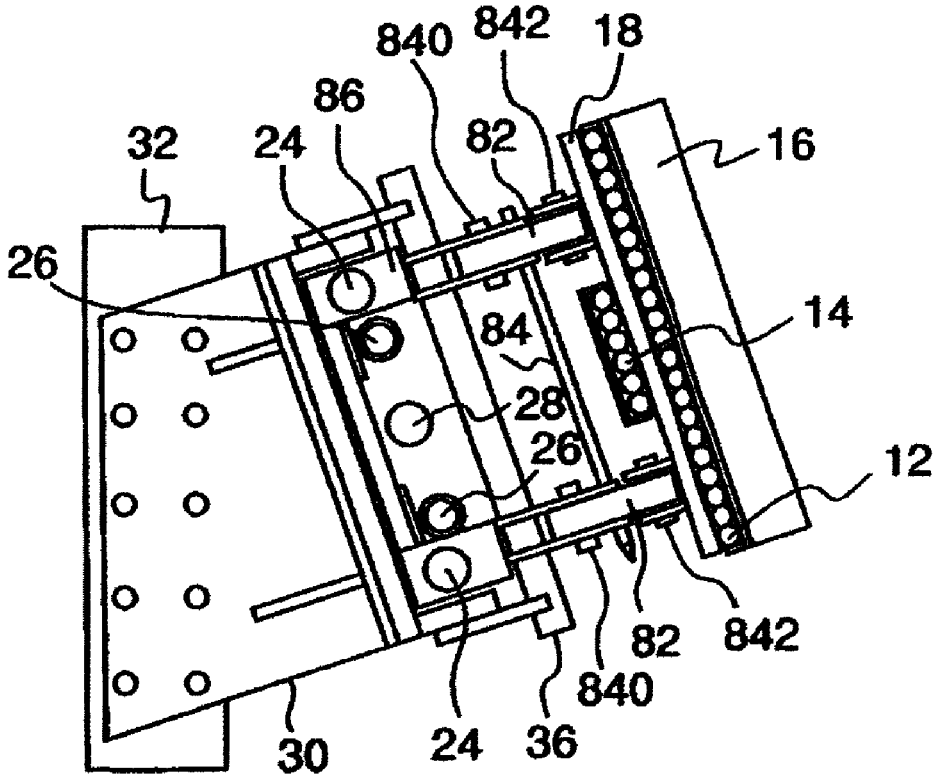
FIG. 6 is a plain view of the obstacle-removing device for guided vehicles of the second embodiment according to the invention.
Figures 7D, 7E, 7F:
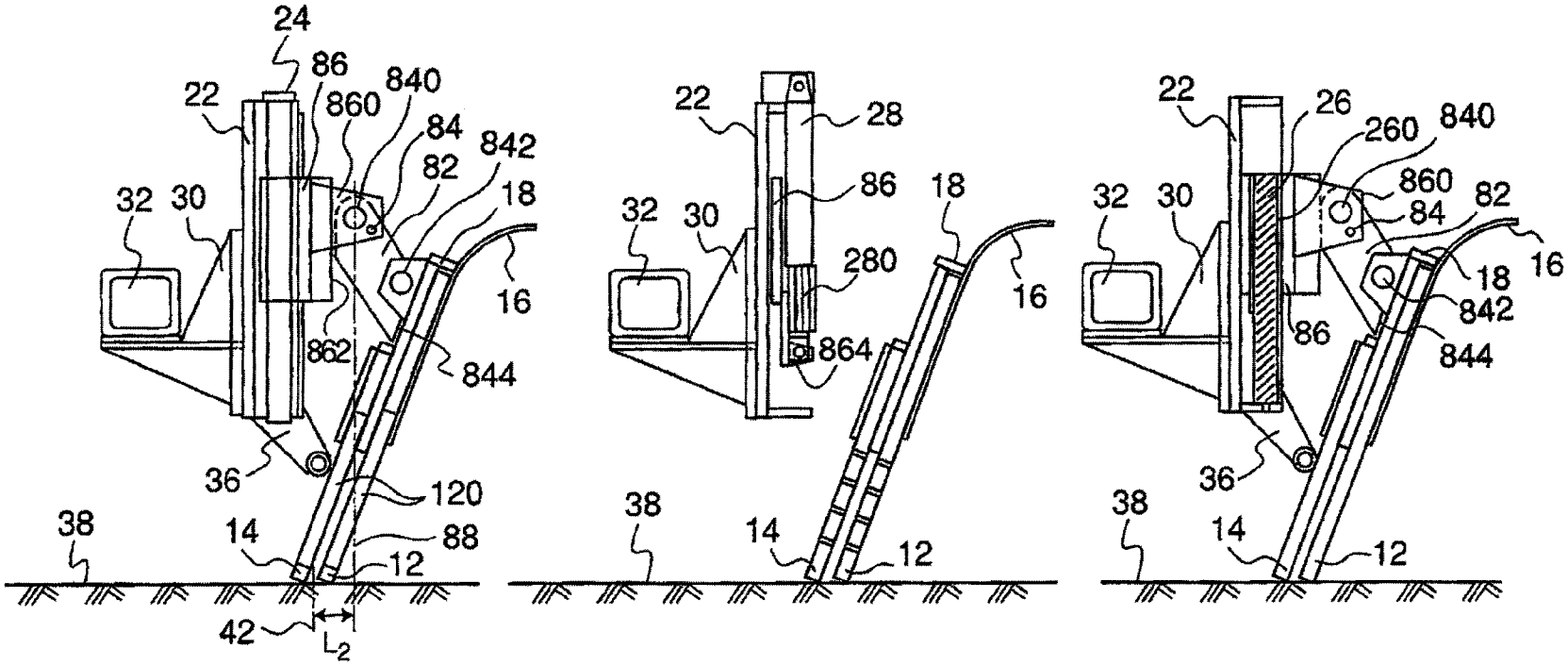
FIGS. 7D, 7E, and 7F are a side view of the second embodiment of the obstacle-removing device for guided vehicles.

A second embodiment shown in FIG. 6 and FIGS. 7D-F is proposed to cope with the occurrence of such a problem as mentioned above. FIG. 6 is a plain view as in FIGS. 2A-C of a second embodiment, and FIGS. 7D-F are side views as in FIGS. 2A-C, and constituent elements the same as those of FIG. 1 and FIGS. 2A-C are denoted by the same reference numerals. Hereunder, different constituent elements will be explained. Reference numeral 82 is a link plate for connecting a supporting frame 86 and the brush holder 18 via a connection pin 840 and connection pin 842. Reference numeral 84 is a lifting stopper pin for stopping lifting of the brush holder 18 at a certain position, 844 is a stopper face of the link plate 82 to prevent the brush holder from rotating in clockwise direction in FIG. 7F at a determined slant position, 860 is a supporting plate fixed to a supporting frame 86, 862 is a stopper face of the supporting frame 86 side, 864 is a connecting point of the piston rod 280 to the supporting frame 86, and 88 indicates a vertical line indicating the center position of the connection pin 820.

In the obstacle-removing device of the second embodiment, the brush holder 18 is connected to the supporting plate 860 of the supporting frame 86 via the link plate 82, which is pivotally connected to the supporting plate 860 and the brush holder 18 via the connection pin 820 and connection pin 822 respectively. Range of clockwise rotation of the link plate 82 about the center of the connection pin 820 are restricted by the stopper face 862 of the supporting frame 86 and that of the brush holder 18 about the center of the connection pin 822 is restricted by the stopper face 844 of the link plate 82. Therefore, even when the brushes consisting of the brush 12 and 14 are pushed strongly by obstacles on the running surface when the vehicle travels, the brush holder 18 is supported strongly against clockwise rotation force from the obstacles, and the obstacles can be removed.

The stopper face 862 of the supporting plate frame 86 and the stopper face 844 of the link plate 82 and the brush stopper 36 are provided such that, when the clockwise rotation of the brush holder 18 is restricted by the stopper faces 862, 844, and the brash stopper 36, the contact center 42 of the brushes to the running surface 38 is positioned backward by L2 from the center line 40 indicating the projection of the pivot center of the brush holder 18 on to the running surface 38.

Therefore, though the bottoms of the brush 12 and 14 are near the vertical center line 40 when the supporting frame 86 is lowered until the bottoms of the brushes contact the running surface 38 before the vehicle moves, once the vehicle moves forward or when the supporting frame 86 is lowered while the vehicle is in motion, the brush holder 18 is rotated clockwise by the force exerting on the bottoms of brushes due to friction with the running surface 38 until the distance of the contact center 42 of the brushes to the running surface 38 from the vertical center line 88 becomes L2. In this state that clockwise rotation of the brushes are stopped by the stopper face 844 and 962 and the brush stopper 36, obstacles on the guideway will be pushed by the brushes and removed toward the guide rail 46 or side wall of the guideway as the vehicle travels, similarly in the case of the first embodiment.

The bristles of the brush 12, 14 are bound with the strings or covered by the tubes indicated by reference numeral 120 along the zone protruding from the brush holder 18 as same as that are in the first embodiment.

With the second embodiment, when the travel direction of the vehicle is reversed and the vehicle travels with the obstacle-removing device positioned to the rear of the vehicle, the brush holder 18 can be rotated counterclockwise viewed from the left of travel direction about the connection pin 820, so even when the pneumatic cylinder 28 of the lifting/lowering mechanism does not actuate due to freezing or other accidents and either of the connection pins 820 or 822 is frozen, the brush holder 18 can be rotated counterclockwise viewed from the left of travel direction about the connection pin not frozen.

The pneumatic circuit and control circuit of the embodiment are the same as those explained referring to FIGS. 5 and 6. These circuits are the same for a third and fourth embodiments explained hereunder.

Figure 8:
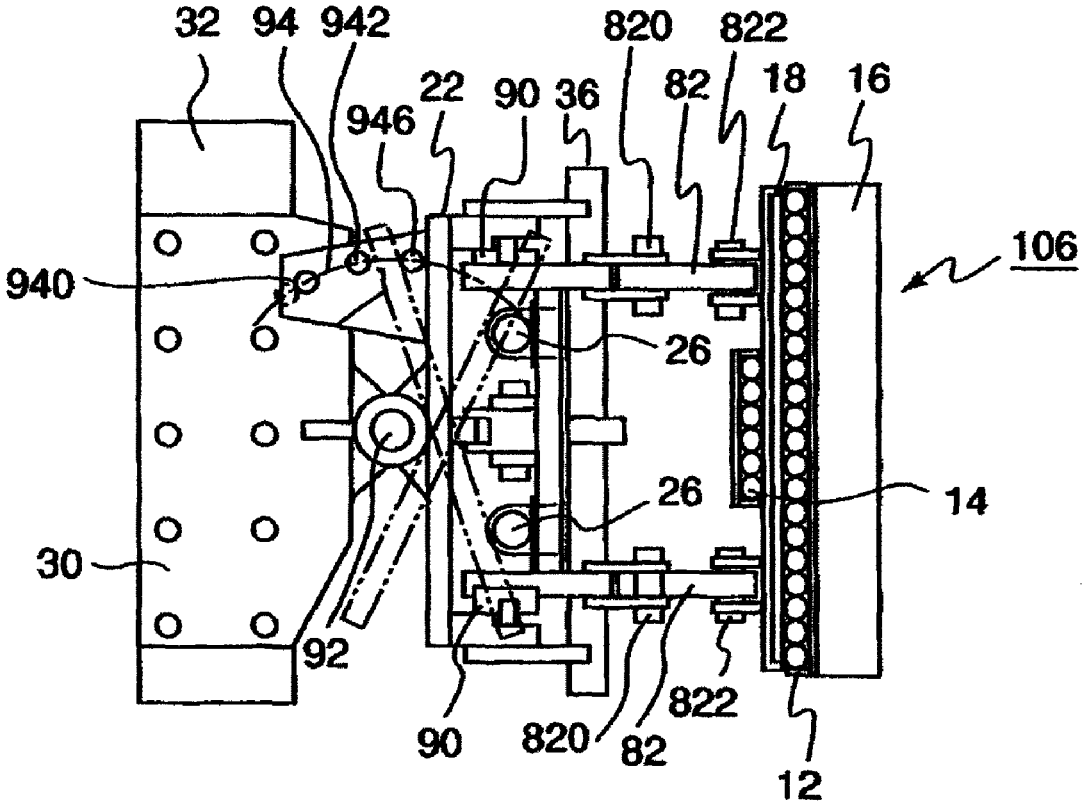
FIG. 8 is a plain view of the obstacle-removing device for guided vehicles of the third and fourth embodiments according to the invention.
Figure 9I:
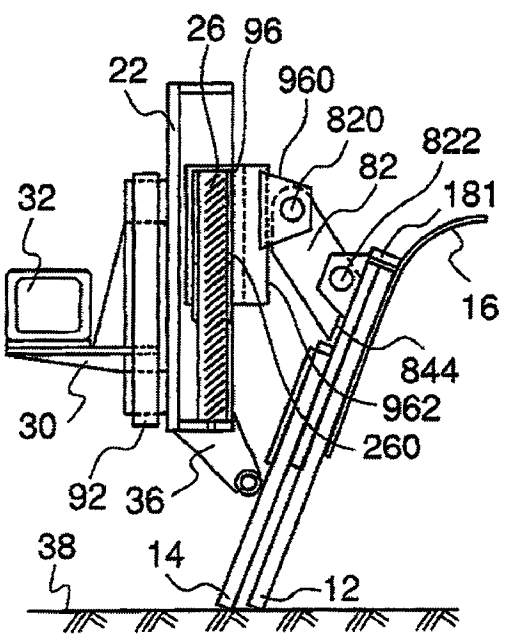
FIGS. 9G, and 9I are a side view of the third and fourth embodiments of the obstacle-removing device for guided vehicles.
Figure 9H:
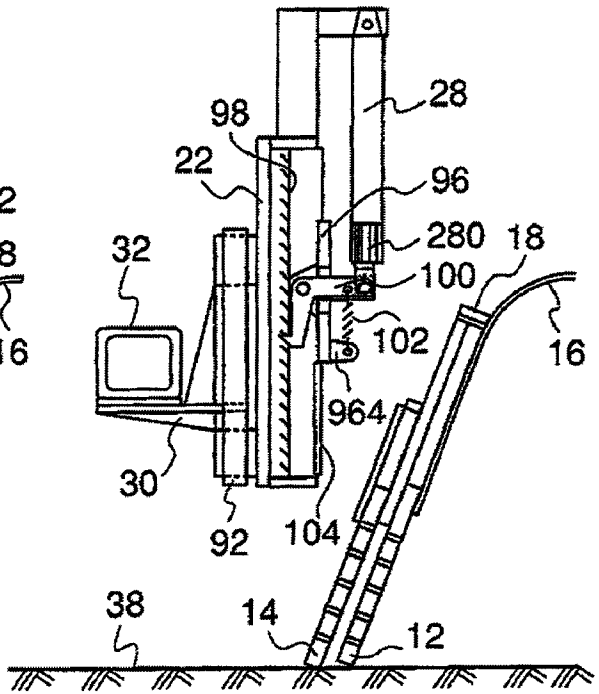
FIG. 9H is a side view showing the lifting/lowering mechanism of the fourth embodiment.
Figure 9G:
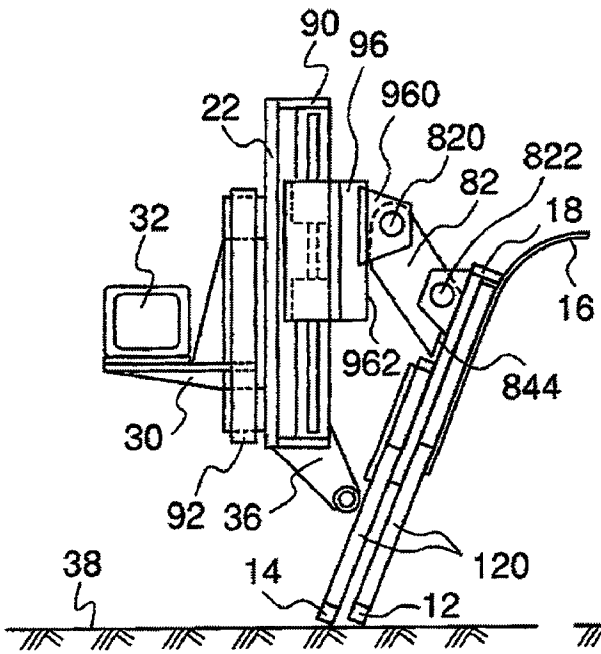
Figure 10:
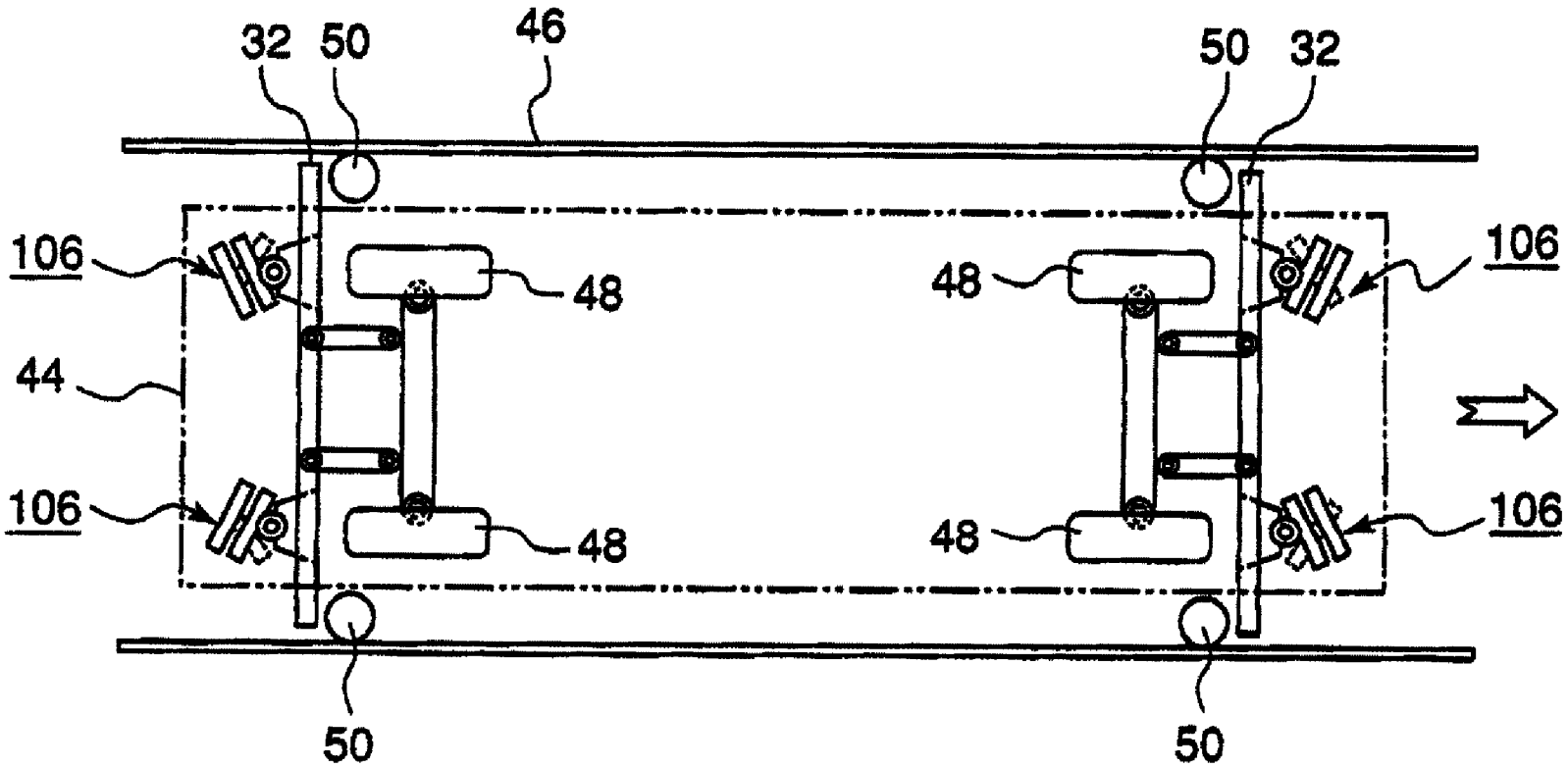
FIG. 10 is a plain view of the guided vehicle equipped with the obstacle-removing device of the third and fourth embodiments for removing obstacles on guideway.

FIG. 8 and FIGS. 9G-I are plain view and side views of the obstacle-removing device of a third and fourth embodiments, and FIG. 10 is a plain view of the guided vehicle equipped with the obstacle-removing device of the third and fourth embodiments for removing obstacles on guideway. In the first and second embodiments, each of the left and right obstacle-removing devices is attached to the vehicle such that the brush holder is skewed to face the guide rail 46 at an angle so that the obstacles on the guideway are removed toward the guide rail 46 side. However, when the amount of snow removed toward the guide rail increases, the snow accumulated beneath the guide rail returns to the running surface where the wheels of the vehicle tread on as space is limited beneath the guide rail 46. The snow returned to the running surface is treaded with the tires to become compressed snow layers. Therefore, the running surface rises up and friction between the tire and running surface decreases, and stable traveling may become impossible.

In the third embodiment, the vertical frame 22, which is fixed to the bracket 30 in the first and second embodiments, is attached to the bracket 30 horizontally pivotally, and it can be fixed at several rotational positions such as a position to remove obstacles on the running surface toward outside of the vehicle, a position to remove obstacles on the running surface toward vehicle underfloor, i.e. between left and right wheels of the vehicle, and a position to take as necessary the right angle to travel direction, etc.

In the first and second embodiments, when lowering the brush holder 18, the pneumatic cylinder 28 must push down the brush holder 18 against upward force of the return spring 28 and maintain the pushing force so that the brushes 12, 14 always contact the running surface 38.

In the fourth embodiments, the device is composed such that the brush holder 18 can be maintained at a lowered position without maintaining the pushing force of the pneumatic cylinder 28. Hereunder, the third and fourth embodiments will be explained with reference to FIG. 8, FIGS. 9G-I, and FIG. 10.

FIG. 8 is a plain view as in FIG. 1 and FIG. 6 of the third and fourth embodiments, FIG. 9G-I are side views as in FIGS. 2A-C and FIG. 7D-F of the third and fourth embodiments, and FIG. 10 is a plain view of a guided vehicle equipped with the third or fourth embodiments of the obstacle-removing device.

Constituent elements similar to those of FIGS. 1, 6, 2A-C, 7D-F are denoted by the same reference numerals, and only different constituent elements will be explained. Reference numeral 90 is a linear guide for guiding a supporting frame 96 instead of the guide shaft 24 in FIGS. 1 and 6, 92 is a pivot shaft for bearing the vertical frame 22 horizontally rotatable, 94 is a location plate protruding from the vertical frame 22 and has positioning holes 940, 942, and 946 to determine rotational position of the vertical frame 22. As to the rotational positioning of the vertical frame 22 is explained later.

Reference numeral 960 is a supporting plate of the supporting frame 96, 962 is a stopper face of the supporting frame 96. Reference numeral 100 is a ratchet claw which has a general shape of a letter 'L' and pivotally supported at its center part, i.e. bending part, to the supporting frame 96. An end of the ratchet claw has a claw part and the other end thereof is connected pivotally to the end of the piston rod 280 of the pneumatic cylinder 28. The ratchet claw 100 is energized by a spring 102 attached between a spring attaching protrusion 964 of the supporting frame 96 and the ratchet claw 100 near a connecting part thereof to the piston rod 280 so that the claw part of the ratchet claw 100 engages firmly with a tooth of a ratchet rail 98 fixed to the vertical frame 22. The vertical frame 22 lowered by the pneumatic cylinder 28 is locked there against upward movement by the engagement of the ratchet claw 100 with the ratchet rail 98. The ratchet rail 98 is covered by a bellows 104 to prevent adhesion of snow by freezing. Reference numerals 106 in FIG. 10 are obstacle-removing device of the third or fourth embodiment of the invention and other constituent elements are the same as those in FIG. 3, so explanation is omitted.

The left and right obstacle-removing devices 106 for removing obstacles on guideway are mounted to the guide beam 32 such that each of the brush holders 18 of the devices 106 is skewed to face toward outside, i.e. to face to the left and right guide rails 50 respectively under normal conditions, but when sufficient space to accommodate replaced obstacles in the side part of the exclusive guideway does not available any more, each device 106 is rotated about the pivot shaft 92 to be skewed to face toward inner side to remove obstacles to the inner side, i.e. to the underfloor of the vehicle between the left and right wheels as shown in FIG. 10 so that the obstacles accumulated in the side part of the guideway do not return to the running surface where the wheels tread on.

Referring to FIG. 8 showing a plain view of the obstacle-removing device of the third and fourth embodiments, the vertical frame 22 to which the brush holder is attached is pivotally attached via the pivot shaft 92 for horizontal rotation, and horizontal rotational position can be determined at several positions as necessary by fixing the vertical frame 22 to the bracket 30. The vertical frame 22 has a location plate 94 protruding toward the bracket 30 and the bracket 30 has a location plate 300 protruding toward the vertical frame 22 under the vertical frame 22. The location plate 94 has three location holes, holes 940, 942 and 946. The location plate 300 has two location holes, holes 301 and 302. In FIG. 8, the hole 940 coincides with the hole 301, and the hole 946 does with the hole 302.

The vertical frame 22 can be fixed at several rotation angles by selecting a combination of the holes of the location plates 94 and 300. For example, by allowing the hole 940 to coincide with the hole 301 (in this state, also the hole 946 coincide with the hole 302) and tightening both the location plates 94 and 300, the vertical frame 22 can be fixed at the right angle position as shown by a solid line in FIG. 8. When the hole 942 or 946 is allowed to coincide with the hole 301, the vertical frame can be fixed at outward position, and when the hole 942 or 940 is allowed to coincide with the hole 302, the vertical frame 22 can be fixed at inward position.

For determination of the horizontal rotational position of the vertical frame 22, an actuator can be adopted in lieu of utilizing the location plates 94, 300 and bolt and nut as explained referring to FIG. 8. By composing such that an actuator is fixed to the bracket 30 and the vertical frame 22 is rotated about the pivot shaft 92 by a rod actuated by the actuator, changing of skew angle of the brush holders can be performed while the vehicle is in motion. Therefore, particularly snow removing operation can be performed meeting promptly the situation of accumulation of snow. As to the actuator, a pneumatic cylinder, hydraulic cylinder, electric motor, etc. can be utilized.

Connection of the brush holder 18 to the supporting frame 96 of the third and fourth embodiments via the link plate 82 and connection pins 820, 822 is similar to that of the second embodiment explained referring to FIG. 6 and FIG. 7D-F except that supporting frame is denoted by reference numeral 86 in the latter case.

When the brush holder 18 is pushed lower by the pneumatic cylinder 28 against the upward force of the return spring 26, the ratchet claw 100 pulled by the coil spring 102 engages with a tooth of the ratchet rail 98 and the brush holder 18 can be held at the lowered position without nee of downward force of the pneumatic cylinder 28. As the supporting frame 96 is pushed upward by the return spring 26, the brush holder 18 is held at the lowered position stably. Lifting of the brush holder 18 is done as follows. By moving the piston rod 280 of the pneumatic cylinder 28 upward, the ratchet claw 100 is pulled by the piston rod 280 to be rotated about its pivoting point to the supporting frame 96 resulting in disengagement of the claw from the tooth of the ratchet rail 98, and the supporting frame 96 can be lifted together with the brush holder 18 by the piston rod 280 of the cylinder 20 aided by the upward force of the return spring 26.

Although the bottoms of the brushes 12 and 14 are near the vertical center line 40 when the supporting frame 96 is lowered until the bottoms of the brushes contact the running surface before the vehicle moves, once the vehicle moves forward or when the supporting frame 96 is lowered while the vehicle is in motion, the brush holder 18 is rotated clockwise by the force on the brushes due to friction with the running surface 38 until the distance of the contact center 42 of the brushes to the running surface 38 from the vertical center line 40 becomes L2 as shown in FIG. 7. In this state that clockwise location of the brushes are stopped by the stopper faces 844 and 962 and the brush stopper 36, obstacles on the guideway will be pushed by the brushes and removed toward the guide rail 46, or side wall of the guideway as the vehicle moves, similarly in the case of the second embodiment.

The bristles of the brushes 12, 14 are bound with the strings or covered by the tubes indicated by reference numeral 120 along the zone protruding from the brush holder 18 as same as that are in the first and second embodiments.

It is a matter of course that the partial mechanisms of the third and fourth embodiments can applies to the first embodiment, and that the arrangement of the brushes 'a' and 'b' is not limited as shown in the embodiments.

According to the invention, an obstacle-removing device for removing obstacles on guideway can be provided which is simple in configuration, low in manufacturing cost, and can remove the obstacles on guideway steadily and effectively.

The invention claimed is:

1. An obstacle-removing device of a guided vehicle for removing obstacles on a guideway on which the vehicle is arranged to travel, said device comprising: at least one brush comprising a plurality of bundles of bristles having rigidity and arranged along a width direction of the vehicle;

a brush holder holding the brush and attached to a vertically movable member;

a vertical frame attached to a leading end in a traveling direction of the vehicle; a lifting/lowering mechanism attached to said vertical frame to lift and lower the brush holder by lifting and lowering the vertically movable member;

a first pivoting point provided between the brush holder and the lifting/lowering mechanism for pivotally supporting a tip end of the brush holder via an intermediate connection member, such that the brush held by the brush holder is rotatable upwardly, the first pivoting point having said intermediate connection member laid in the width direction of the vehicle; and a first stopper face for restricting a rotation of the brush held by the brush holder toward the vehicle about the first pivoting point;

wherein the brush holder is pivotally attached such that a contact point between the brush held by the brush holder and a running surface is positioned posterior to the intermediate connection member of the first pivoting point in the traveling direction of the vehicle so that the brush holder tilts forward when the brush held by the brush holder contacts the running surface to perform an obstacle-removing operation.

2. An obstacle-removing device according to claim 1, further comprising:

a second pivoting point provided between the lifting/lowering mechanism and the first pivoting point, the second pivoting point having said intermediate connection member such that the brush holder tilts forward when the brush contacts the running surface to perform the obstacle-removing operation; and a second stopper face for restricting a rotation of the brush held by the brush holder toward the vehicle about the second pivoting point.

3. An obstacle-removing device according to claim 1, further comprising:

a guide beam provided to the leading end in the traveling direction of the vehicle, wherein said vertical frame is attached to said guide beam such that said vertical frame is horizontally rotatable, and means for fixing the vertical frame at a determined rotational position.

4. An obstacle-removing device according to claims 1, further comprising:

a ratchet rail attached to said vertical frame, and a ratchet claw pivotally attached to the vertically movable member and engaged with the ratchet rail for locking the vertically movable member, to which the brush holder is connected, not to move upward when the vertically movable member is lowered by the lifting/lowering mechanism.

5. An obstacle-removing device according to claim 4, wherein said ratchet claw has a general shape of a letter 'L' including two ends and a central part between said two ends, the central part is pivotally attached to the vertically movable member, one of the two ends has a claw part engaging with the ratchet rail, and the other end is connected pivotally to the lifting/lowering mechanism.

6. An obstacle-removing device according to claim 1, wherein the bristles of each bundle is bound up with a binding string or stuffed into a tube in a zone from the bottom of the brush holder to near the top of the bundle.

7. An obstacle-removing device according to claim 6, wherein the at least one brush includes two brushes arranged side by side in two parallel rows parallel to the vertical frame.

8. An obstacle-removing device according to claim 7, further comprising:

a brush cover attached to the brush holder and having a top face protruding forward from a top end of the brush holder in a curved form.

9. An obstacle-removing device according to claim 8, further comprising:

a return spring for pushing upward the vertically movable member which is lowerable by the lifting/lowering mechanism against an upward force of the return spring; and a spring cover covering the spring.

10. An obstacle-removing device according to claim 9, further comprising:

a brush stopper provided to the vertical frame between the vertical frame and the brush.

* * * * *